US010482871B2

(12) United States Patent
Yan

(10) Patent No.: US 10,482,871 B2
(45) Date of Patent: Nov. 19, 2019

(54) METHOD FOR PROCESSING SIGNALS, TERMINAL DEVICE, AND NON-TRANSITORY COMPUTER-READABLE STORAGE MEDIUM

(71) Applicant: Guangdong Oppo Mobile Telecommunications Corp., Ltd., Dongguan, Guangdong (CN)

(72) Inventor: Bixiang Yan, Guangdong (CN)

(73) Assignee: Guangdong Oppo Mobile Telecommunications Corp., Ltd., Dongguan (CN)

( * ) Notice: Subject to any disclaimer, the term of this patent is extended or adjusted under 35 U.S.C. 154(b) by 0 days.

(21) Appl. No.: 16/229,410

(22) Filed: Dec. 21, 2018

(65) Prior Publication Data

US 2019/0304432 A1 Oct. 3, 2019

(30) Foreign Application Priority Data

Mar. 30, 2018 (CN) ..... 2018 1 0276612

(51) Int. Cl.
*G10K 11/178* (2006.01)
*H04R 1/10* (2006.01)
*H04R 3/12* (2006.01)

(52) U.S. Cl.
CPC ..... *G10K 11/17881* (2018.01); *H04R 1/1083* (2013.01); *H04R 3/12* (2013.01);
(Continued)

(58) Field of Classification Search
CPC ..... H04L 67/18; H04M 3/42; H04M 1/05; H04M 1/6066; H04M 2250/04;
(Continued)

(56) References Cited

U.S. PATENT DOCUMENTS

2008/0187163 A1* 8/2008 Goldstein ..... H04R 25/70 381/380
2015/0222977 A1* 8/2015 Angel, Jr. ..... H04R 1/105 381/74

FOREIGN PATENT DOCUMENTS

CN 102595265 A 7/2012
CN 103428593 A 12/2013
(Continued)

OTHER PUBLICATIONS

International search report issued in corresponding international application No. PCT/CN2018/116742 dated Feb. 26, 2019.
(Continued)

*Primary Examiner* — Lun-See Lao
(74) *Attorney, Agent, or Firm* — Young Basile Hanlon & MacFarlane, P.C.

(57) ABSTRACT

A method for processing signals, a terminal device, and a non-transitory computer-readable storage medium are provided. The method includes the following. A sound signal of external environment is recorded via a microphone of a headphone when the headphone is in a playing state. Feature audio in the sound signal is identified and reminding information corresponding to the feature audio is acquired. Inquire of a user whether recorded sound signal is critical according to the reminding information in response to the headphone being paused. An input operation of the user is detected and the sound signal is processed according to the input operation of the user.

20 Claims, 5 Drawing Sheets

(52) U.S. Cl.
CPC ..... *G10K 2210/1081* (2013.01); *G10K 2210/3016* (2013.01)

(58) Field of Classification Search
CPC ..... H04M 2250/10; H04M 2250/68; H04M 2250/74; H04W 4/021; H04W 4/023; H04W 4/025; H04W 4/029; H04W 64/006; H04W 68/00; H04H 60/27; H04H 60/47; H04H 60/48; H04H 60/51; H04N 21/23418; H04N 21/23424; H04N 21/2353; H04N 21/251; H04N 21/2187; H04N 21/233; H04N 21/2393; H04N 21/2541; H04N 21/47205; H04N 21/47217; H04N 21/4722; H04N 21/4882; H04N 21/6405; H04N 21/6587; H04N 21/812; H04N 21/8126; H04N 21/814; H04N 21/816; H04N 21/84; H04N 21/8455; H04N 21/8456; H04N 21/854; H04R 1/1041; H04R 1/105; H04R 1/1083; H04R 1/1091; H04R 2420/01; H04R 2460/01; H04R 2499/11; H03G 5/165
USPC ..... 381/71.1–71.6, 94.1–94.5, 74, 370, 381/56–58, 300, 309, 374; 700/94
See application file for complete search history.

(56) References Cited

FOREIGN PATENT DOCUMENTS

| | | | | | |
|---|---|---|---|---|---|
| CN | 103581786 | A | | 2/2014 | |
| CN | 105528440 | A | | 4/2016 | |
| CN | 105635872 | A | | 6/2016 | |
| CN | 105681529 | | * | 6/2016 | ..... H04M 1/60 |
| CN | 105681529 | A | | 6/2016 | |
| CN | 106412225 | | * | 2/2017 | ..... H04M 1/725 |
| CN | 106412225 | A | | 2/2017 | |
| CN | 107333199 | A | | 11/2017 | |
| CN | 107580113 | A | | 1/2018 | |
| CN | 107799117 | | * | 3/2018 | ..... G10L 15/22 |
| CN | 107799117 | A | | 3/2018 | |
| EP | 0290415 | A1 | | 11/1988 | |
| WO | 2007007916 | A1 | | 1/2007 | |
| WO | 2011100890 | A1 | | 8/2011 | |
| WO | WO 2011/100890 | | * | 8/2011 | ..... H04M 1/725 |

OTHER PUBLICATIONS

Extended European search report issued in corresponding European application No. 18208019.2 dated Jun. 3, 2019.

* cited by examiner

METHOD FOR PROCESSING SIGNALS, TERMINAL DEVICE, AND NON-TRANSITORY COMPUTER-READABLE STORAGE MEDIUM

CROSS-REFERENCE TO RELATED APPLICATION(S)

This application claims priority to and the benefit of Chinese Application Patent Serial No. 201810276612.1, filed on Mar. 30, 2018, the entire disclosure of which is hereby incorporated by reference.

TECHNICAL FIELD

This disclosure relates to the technical field of communication, and more particularly to a method for processing signals, a terminal device, and a non-transitory computer-readable storage medium.

BACKGROUND

With the intelligent development of communication devices, people use smart terminals more and more frequently in daily lives, and a variety of activities such as video communication, calling, voice communication, music listening, video playback, and the like can be carried out by using the smart terminal. As a tool for transmitting sound, headphones bring better listening experience to the people and are widely used in people's daily lives. A user can use the headphone to listen to music, make calls, conduct voice or video communication, and play video. In more and more occasions, people like to wear headphones. Furthermore, the effects of sound insulation and noise reduction of the headphones are getting better and better.

When a user wears a headphone to listen to sound played by a terminal device, hearing of the user, which can assist visual sense, is greatly restricted by the sound played by the headphone. The user is hard to notice sound signals of external environment, which may cause missing some important information such as contents of other's speech. Therefore, the user may have to take off the headphone or pause the headphone to receive external sound, which may affect the user experience.

SUMMARY

Implementations of the disclosure provide a method for processing signals, a terminal device, and a non-transitory computer-readable storage medium.

A method for processing signals is provided. The method includes the following. A sound signal of external environment is recorded via a microphone of a headphone when the headphone is in a playing state. Feature audio in the sound signal is identified and reminding information corresponding to the feature audio is acquired. Inquire of a user whether recorded sound signal is critical according to the reminding information in response to the headphone being paused. An input operation of the user is detected and the sound signal is processed according to the input operation of the user.

A terminal device is provided. The terminal device includes at least one processor and a computer readable storage. The computer readable storage is coupled to the at least one processor and configured to store at least one computer executable instruction thereon which, when executed by the at least one processor, cause the at least one processor to carry out actions, including: recording a sound signal of external environment when the headphone is in a playing state; identifying feature audio in the sound signal and acquiring reminding information corresponding to the feature audio; inquiring of a user whether recorded sound signal is critical according to the reminding information, in response to the headphone being paused; detecting an input operation of the user and processing the sound signal according to the input operation of the user.

A non-transitory computer-readable storage medium is provided. The non-transitory computer-readable storage medium is configured to store a computer program which, when executed by a processor, causes the processor to carry out actions, including: recording a sound signal of external environment when the headphone is in a playing state; identifying feature audio in the sound signal and acquiring reminding information corresponding to the feature audio; inquiring of a user whether recorded sound signal is critical according to the reminding information, in response to the headphone being paused; detecting an input operation of the user and processing the sound signal according to the input operation of the user.

BRIEF DESCRIPTION OF DRAWINGS

To illustrate the technical solutions embodied by the implementations of the present disclosure more clearly, the following briefly introduces the accompanying drawings required for describing the implementations or the related art. Apparently, the accompanying drawings in the following description merely illustrate some implementations of the present disclosure. Those of ordinary skill in the art may also obtain other drawings based on these accompanying drawings without creative efforts.

DETAILED DESCRIPTION

To illustrate objectives, technical solutions, and advantageous effects of the disclosure more clearly, the specific implementations of the present disclosure will be described in detail herein with reference to accompanying drawings. It will be appreciated that the implementations are described herein for the purpose of explaining the disclosure rather than limiting the disclosure.

All technical and scientific terms used herein have the same meaning as commonly understood by those of ordinary skill in the art to which this disclosure applies, unless otherwise defined. The terms used herein is for the purpose of describing particular implementations only, and is not intended to limit the disclosure.

Figure 1:
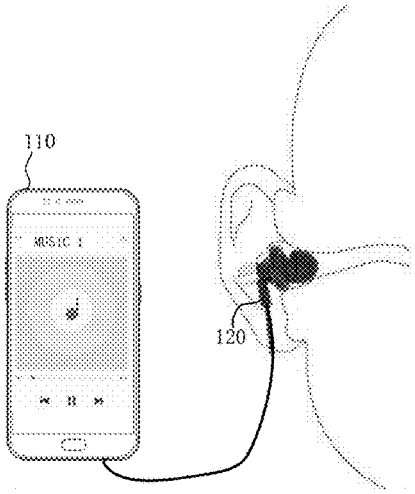
FIG. 1 is a schematic diagram illustrating an application scenario of a method for processing signals according to an implementation of the present disclosure.

FIG. 1 is a schematic diagram illustrating an application scenario of a method for processing signals according to an implementation of the present disclosure. As illustrated in FIG. 1, the application scenario includes a terminal device 110 and a headphone 120 in communication with the terminal device 110.

The terminal device 110 can communicate with the headphone 120. The headphone 120 includes, but is not limited to, an in-ear headphone and an earplug headphone. The terminal device 110 and the headphone 120 can conduct wired or wireless communication to realize data transmission.

The terminal device 110 may play an audio signal, which may be a signal of music, video sound, calling sound, or the like. The audio signal played by the terminal device 110 is transmitted to a user's ear through the headphone 120, so that the user can hear the sound. On the other hand, the headphone 120 can also collect an audio signal, which may be a signal of user's voice, sound of external environment, or the like. The audio signal collected by the headphone 120 is transmitted to the terminal device 110 for processing and can be used for voice communication, sound instruction, audio noise reduction, and the like.

The headphone 120 includes an electroacoustic transducer. As an implementation, the electroacoustic transducer includes a first microphone, a first speaker (that is, a left speaker), and a second speaker (that is, a right speaker). Any one of the first speaker and the right speaker is disposed at a tip portion of the headphone 120. When the tip portion of the headphone 120 is placed in an ear canal of the user, any one of the first speaker and the right speaker can output the audio signal played by the terminal device 110 into the ear canal of the user. As an implementation, the electroacoustic transducer includes a first microphone, a first speaker (that is, a left speaker), a second speaker (that is, a right speaker), and a second microphone, Any one of the first speaker and the right speaker is configured to play the audio signal sent by the terminal device 110. The first microphone is configured to collect a sound signal (mainly configured to collect a voice signal of the user). The second microphone is also configured to record an audio signal around the headphone 120. As an implementation, any one of the first speaker and the right speaker is integrated with the second microphone.

Figure 2:
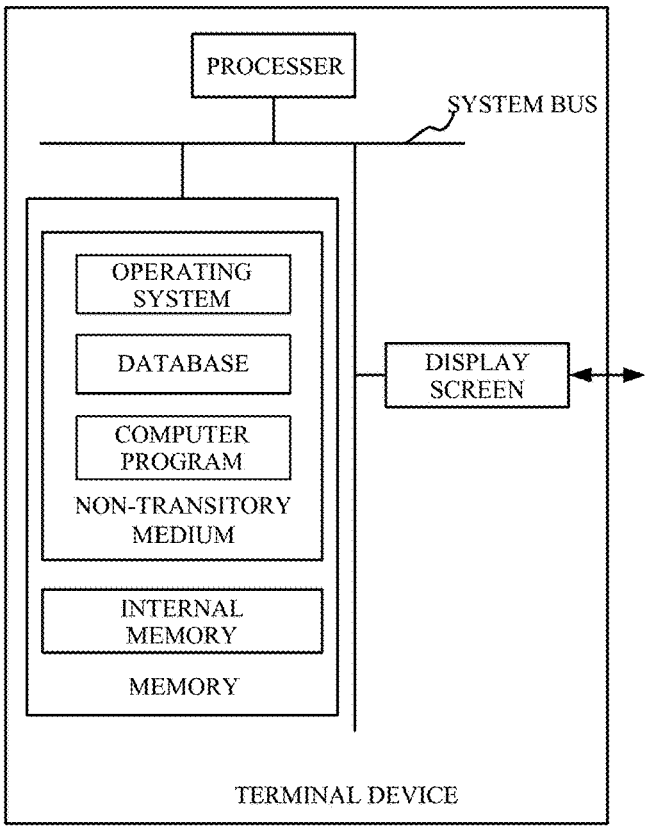
FIG. 2 is a schematic structural diagram illustrating an inner structure of a terminal device according to an implementation of the present disclosure.

FIG. 2 is a schematic structural diagram illustrating an inner structure of a terminal device according to an implementation. The terminal device 110 includes a processor, a memory, and a display screen which are coupled via a system bus. The processor is configured to provide computing and control capabilities to support operation of the entire terminal device 110. The memory is configured to store data, programs, and/or instruction codes. The memory stores at least one computer program which can be executed by the processor to implement a method for processing signals applicable to the terminal device 110 according to implementations of the present disclosure. The memory may include a non-transitory storage medium such as a magnetic disk, a compact disk (CD), and a read-only memory (ROM), or may include a random access memory (RAM). As an implementation, the memory includes a non-transitory storage medium and an internal memory. The non-transitory storage medium is configured to store an operating system, a database, and computer programs. Data associated with the method for processing signals according to implementations of the disclosure are stored in the database. The computer programs can be executed by the processor to implement the method for processing signals according to the implementations of the present disclosure. The internal memory provides a cached execution environment for the operating system, the database, and the computer programs of the non-transitory storage medium. The display screen may be a touch screen such as a capacitive touch screen and a resistive touch screen, and is configured to display interface information of the terminal device 110. The display screen can be operable in a screen-on state and a screen-off state. The terminal device 110 may be a mobile phone, a tablet computer, a personal digital assistant (PDA), a wearable device, and the like.

Those skilled in the art can understand that the structure illustrated in FIG. 2 is only a partial structure related to the technical solutions of the present disclosure, and does not constitute any limitation on the terminal device 110 to which the technical solutions of the present disclosure are applied. The terminal device 110 may include more or fewer components than illustrated in the figure or be provided with different components, or certain components can be combined.

Figure 3:
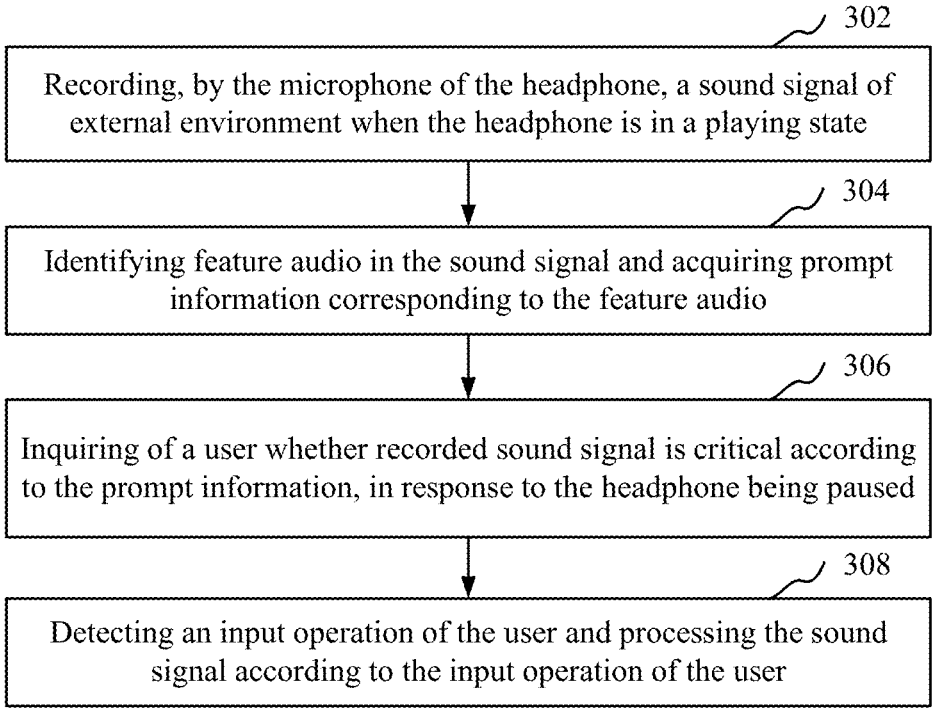
FIG. 3 is a schematic flow chart illustrating a method for processing signals according to an implementation of the present disclosure.

FIG. 3 is a schematic flow chart illustrating a method for processing signals according to an implementation of the present disclosure. The method of the implementation for example can be implemented on the terminal device or the headphone illustrated in FIG. 1, where the headphone includes a microphone configured to collect a sound signal. The method begins at block 302.

At block 302, a sound signal of external environment is recorded via the microphone of the headphone when the headphone is in a playing state.

The headphone can conduct wired or wireless communication with the terminal device. When the headphone is in the playing state, the terminal device transmits an audio signal to the headphone, and then a sound is transmitted to a user's ear through the speaker. When the headphone is in the playing state, the user can use the headphone to talk, listen to music, or listen to audio books. The playing state of the headphone refers to a state that the headphone is working and is worn on the user's ear.

As an implementation, the microphone includes a first microphone and a second microphone. The sound signal of external environment is recorded when the headphone is in a playing state as one of the following.

The sound signal of external environment is recorded via the first microphone of the headphone when the headphone playing music through the headphone.

The sound signal of external environment is recorded via the second microphone of the headphone when the user talking through the headphone.

As an implementation, the sound signal of external environment can be recorded via the first microphone of the headphone when the headphone is in the playing state. The first microphone of the headphone is usually placed close to the user's lips, such that it is easy to collect a voice signal from the user when the user is talking. When the headphone is in the playing state, for example, when the user uses the headphone to listen to music, watch video, listen to broadcast, and the like, the first microphone of the headphone is in an idle state, that is, the first microphone at this time does not need to collect voice signal from the user and thus can be used to record the sound signal of the external environment.

As an implementation, the headphone may further include a second microphone. The second microphone is disposed close to any one of the first speaker and second speaker of the headphone, and the sound signal of the external environment can be recorded through the second microphone. For example, when the user makes a call through the headphone, the first microphone of the headphone is occupied and therefore cannot obtain the sound signal of the external environment. In this case, the second microphone disposed on the headphone can be used to record the sound signal of the external environment.

At block 304, feature audio in the sound signal is identified and reminding information corresponding to the feature audio is acquired.

The feature audio includes, but is not limited to, "person feature audio", "time feature audio", "location feature audio", and "event feature audio". As an implementation, "person feature audio" may be an audio signal including a name and a nickname of a person or a company that the user pays attention to. "Time feature audio" may be an audio signal including numbers and/or dates. "Location feature audio" may refer to an audio signal including information of user's country, city, company, and home address. "Event feature audio" may be special alert audio including a siren and a cry for help for example.

For example, assume that user A stores an audio of a user' name "A" and an audio of a user' another name "B" as feature audio (both "A" and "B" refer to user' names). When a person says "A" or "B" and a similarity between the feature audio stored and what the person said reaches a preset level, it is determined that the sound signal contains the feature audio. When the sound signal contains the feature audio, acquire the reminding information corresponding to the feature audio.

The reminding information may include at least one of first reminding information and second reminding information. The first reminding information is presented by the headphone, which means that a certain recording is played through the headphone to be transmitted to the user's ear so as to remind the user. The second reminding information is presented by the terminal device in communication with the headphone, where the terminal device may conduct reminding through interface display, a combination of the interface display and ringtone, a combination of interface display and vibration, or the like. All other reminding manners that can be expected by those skilled in the art shall fall within the protection scope of the present disclosure.

At block 306, inquire of the user whether recorded sound signal is critical according to the reminding information, in response to the headphone being paused.

The headphone being paused refers to discontinuity of signal transmission when the headphone plays an audio signal. For example, when playing a song through the headphone, the headphone is in a continuous playing state. When the play ends, signal transmission is interrupted and the headphone is paused until a next song is played.

For example, during playing music through the headphone, when music or song switching is detected, the headphone is regarded as being paused. At this time, inquire of the user whether the recorded sound signal is critical according to the reminding information. For instance, when the recorded sound signal of the external environment contains "person feature audio", the user may be reminded "someone just mentioned you, do you want to listen to the recoding" when the play of a song ends. In this way, the recorded sound signal can be presented to the user, and the user may quickly determine whether the recorded sound signal is critical, thus avoiding missing important information.

As an implementation, in response to a music pause instruction input by the user, inquire of the user whether the recorded sound signal is critical according to the reminding information. In this way, the user can pause the music manually to acquire the reminding information when he/she wants to know the recorded sound signal immediately.

At block 308, an input operation of the user is detected and the sound signal is processed according to the input operation of the user.

The input operation may be received on the headphone or on the terminal device. When the input operation is received on the headphone, the input operation may be operated on a physical key of the headphone or on a housing of the headphone. When the input operation is received on the terminal device, the input operation may include, but is not limited to, a touch operation, a press operation, a gesture operation, a voice operation, and the like. As an implementation, the input operation can also be implemented by other control devices, such as a smart bracelet or a smart watch, which is not limited herein.

Furthermore, when the input operation of the user is detected, whether to play the sound signal is determined according to the input operation. When the input operation indicates that the user wants to play the sound signal, play the sound signal. When the input operation indicates that the user does not want to play the sound signal, delete a stored audio file corresponding to the sound signal to save storage space.

According to the method of the disclosure, the microphone of the headphone records the sound signal of the external environment when the headphone is in the playing state. The feature audio in the sound signal is identified and the reminding information corresponding to the feature audio is acquired. Inquire of the user whether the recorded sound signal is critical according to the reminding information in response to the headphone being paused. The input operation of the user is detected and the sound signal is processed according to the input operation of the user. In this way, headphone playing and external sound acquisition can be both taken into account, and the user can be reminded according to the recorded content so that the user will not miss important information when he or she wears the headphone, thus improving convenience in the process of using the headphone and further enhancing use experience.

Figure 4:
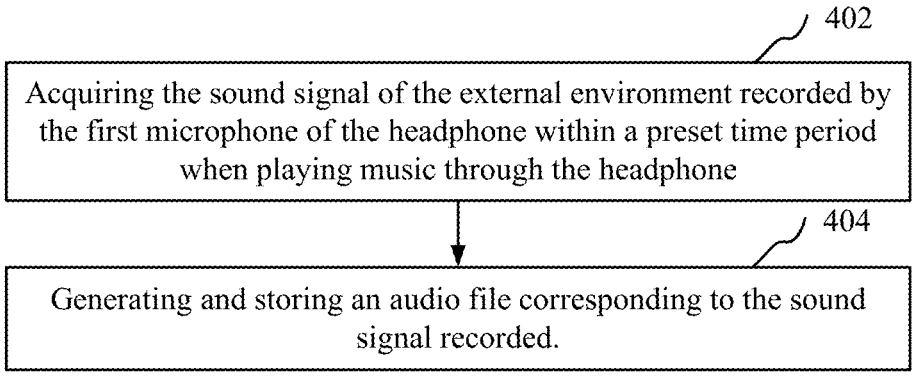
FIG. 4 is a schematic flow chart illustrating a method for processing signals according to another implementation of the present disclosure.

As an implementation, as illustrated in FIG. 4, the sound signal of the external environment is recorded via the microphone of the headphone when the headphone is in the playing state as follows.

At block 402, the sound signal of the external environment recorded via the first microphone of the headphone within a preset time period is acquired when music is played through the headphone.

When playing music through the headphone, since the first microphone of the headphone does not need to acquire the user's voice signal and is in an idle state, then the first microphone can be used to record the sound signal of the external environment. The sound signal can be recorded within the preset time period. As an implementation, the preset time period may be determined according to a time period in which the music is played. Since the user generally only wants to know external situation in a recent time period, when wearing the headphone to listen to music, the user is hard to hear an external sound, and therefore it only needs to record the sound signal in the process of playing music. A time period in which the music is played is acquired before recording of the sound signal, and then a time period of the recording of the sound signal is determined according to the time period in which the music is played. For example, when the music is played for three minutes, a sound signal with a length equal to or less than three minutes can be recorded through the first microphone of the headphone. As an implementation, the preset time period may be a fixed period or may be set according to user's requirement, which is not limited herein.

At block 404, an audio file corresponding to the sound signal recorded is generated and stored.

As an implementation, the audio file corresponding to the sound signal recorded is generated and stored in a preset storage path. In another implementation, the number of audio files stored can be preset, and an oldest audio file may be overwritten with a newly generated audio file through an update-and-iterative process. Because of the real-time nature of information, an audio file that the user has listened to can be deleted to avoid occupying system memory. In this way, the storage space can be effectively saved.

Figure 5:
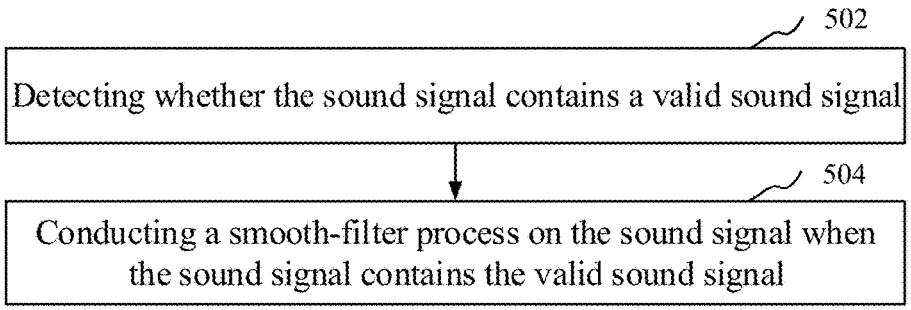
FIG. 5 is a schematic flow chart illustrating a method for processing signals according to yet another implementation of the present disclosure.

As an implementation, as illustrated in FIG. 5, the method further includes the following operations at blocks 502 to 504 before the feature audio in the sound signal is identified.

At block 502, whether the sound signal contains a valid sound signal is detected.

The sound signal recorded may contain noise components because of ambient noise. It is necessary to distinguish the valid sound signal from the sound signal to avoid an influence of noise on feature audio identification and estimation of time delay.

A "short-time zero-crossing rate" refers to the number of times of abnormal values appearing in waveform acquisition values in a certain frame of a sound signal. In a valid sound signal segment, the short-time zero-crossing rate is low, while in a noise signal segment or a silence signal segment, the short-time zero-crossing rate is relatively high. By detecting the short-time zero-crossing rate, whether the sound signal contains the valid sound signal can be determined.

As an implementation, whether the sound signal contains the valid sound signal can also be determined through short-time energy detection.

At block 504, a smooth-filter process is conducted on the sound signal when the sound signal contains the valid sound signal.

When the sound signal contains the valid sound signal, the sound signal may be smoothed by windowing and framing. "Framing" is to divide the sound signal into multiple frames according to a same time period, so that each frame becomes more stable. "Windowing and framing" is to weight each frame of the sound signal by a window function. Here, we use a Hamming window function with lower sidelobe level for example.

In addition, frequency of the noise signal may be distributed throughout the frequency space. "Filtering" refers to a process of filtering signals of a specific frequency band in a sound signal, so as to preserve signals in the specific frequency band and attenuate signals in other frequency bands. The smoothed sound signal can be clearer after filtering.

Figure 6:
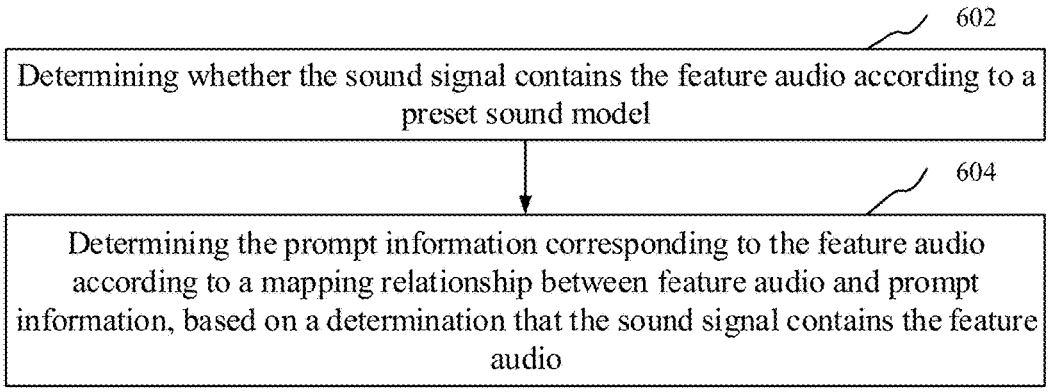
FIG. 6 is a schematic flow chart illustrating a method for processing signals according to still another implementation of the present disclosure.

As an implementation, as illustrated in FIG. 6, identify feature audio in the sound signal and acquire reminding information corresponding to the feature audio as follows.

At block 602, determine whether the sound signal contains the feature audio according to a preset sound model.

The preset sound model refers to sound signals with specific frequencies. The preset sound model includes, but is not limited to, "noise feature model", "person feature model", "time feature model", "location feature model", and "event feature model". The preset sound model is stored in a database and can be invoked and matched when necessary. As an implementation, the preset sound model can be added, deleted, and modified according to user's habit, so as to meet the needs of different users.

As an implementation, "noise feature model" may include sound the user should pay attention to, such as horn sound, alarm sound, knocking sound, a cry for help, and the like. "Person feature model" may be an audio signal including a name and a nickname of a person or a company that the user pays attention to. "Time feature model" may be an audio signal including numbers and/or dates. "Location feature model" may be an audio signal including user's country, city, company, and home address.

Furthermore, when the sound signal contains the valid sound signal, analyze the valid sound signal to see whether the sound signal contains the feature audio. In particular, the feature audio in the sound signal is identified, and whether the feature audio is matched with a preset sound model is determined. The identification process can be conducted as follows. Noise information in the sound signal is extracted, and whether the noise information is matched with a preset noise feature model is determined; voiceprint information of the sound signal is extracted, and whether the voiceprint information is matched with sample voiceprint information is determined; sensitive information of the sound signal is extracted, and whether the sensitive information is matched with a preset key word is determined.

For example, when it is identified that the sound signal contains the horn sound, the feature audio in the sound signal is determined to be matched with the preset sound model. For another example, if user A stores the audio of the user's name "A" and the audio of the user's another name "B" as feature audio, when a person says "A" or "B" and a similarity between the feature audio stored and what the person said reaches a preset level, the sound signal of the external environment is determined to contain the feature audio.

At block 604, reminding information corresponding to the feature audio is determined according to a correspondence between feature audio and reminding information, based on a determination that the sound signal contains the feature audio.

The reminding information is acquired by summarizing content of the feature audio, and is configured to remind the user to pay attention to important content in the sound signal. Different feature audio may correspond to different reminding information, or the reminding information may be customized according to input content of the user. For example, if a user A stores the audio of the user's name "A" and the audio of the user's another name "B" as feature audio, when it is identified that the sound signal contains the feature audio, the corresponding reminding information "someone just mentioned you" may be presented, to remind the user to pay attention to content recorded via the headphone. It should be noted that the reminding information may be transmitted to the user in the manner of playing through the headphone, or may be transmitted to the user as a prompt message on the display screen of the terminal device, or may be viewed by the user through other display means, which is not limited herein.

Furthermore, the feature audio includes, but is not limited to, "person feature audio", "time feature audio", "location feature audio", and "event feature audio". As an implementation, the reminding information may be set according to preset priorities of the feature audio. The feature audio is sorted as follows in a descending order of priorities: event feature audio—a name or a nickname of the user in the person feature audio—a name or a nickname of a person or a company that the user pays attention to in the person feature audio—time feature audio—location feature audio. Different feature audio may correspond to different reminding information. The reminding information corresponding to the feature audio can be determined according to the correspondence between the feature audio and the reminding information.

Figure 7:
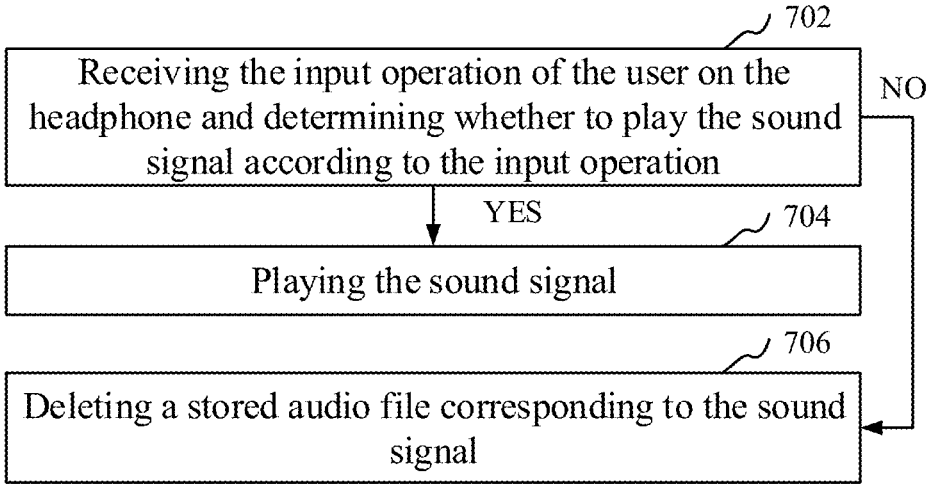
FIG. 7 is a schematic flow chart illustrating a method for processing signals according to still another implementation of the present disclosure.

As an implementation, as illustrated in FIG. 7, an input operation of the user is detected and the sound signal is processed according to the input operation of the user as follows.

At block 702, the input operation of the user on the headphone is received and whether to play the sound signal is determined according to the input operation.

As an implementation, the input operation may be any operation such as tapping, pressing, or the like performed by the user at any position on the headphone housing. The electroacoustic transducer for playing an audio signal (the electroacoustic transducer for playing an audio signal may refer to at least one of the first speaker and the second speaker) can acquire a sound signal generated by the tapping, pressing, or the like, and the sound signal can be taken as a vibration signal. Since the tapping or the pressing is of short duration and the vibration signal is transmitted through a solid, the vibration signal generated by the tapping or the pressing is different from a vibration signal generated by other forces or a vibration signal generated by an external vibration source transmitted through the headphone. Therefore, the input operation of the user can be detected by analyzing the vibration signal the headphone acquires.

As an implementation, a leak port for balancing air pressure can be disposed on the headphone. When an input operation of the user on the leak port of the headphone is received, a frequency-response curve related to an acoustic structure of the headphone can be acquired according to an audio signal currently played by the headphone, and the input operation of the user can be identified according to different frequency-response curves. For example, when the user uses the headphone to listen to music, watch videos, answer calls, and the like, the user may perform an input operation such as covering, plugging, pressing, and the like on the leak port of the headphone. The input operation includes covering the leak port on the earphone housing at a preset position, within a preset time period, with a preset frequency, and the like. Whether to play the sound signal can be determined according to different input operations. The method proceeds to operations at block 704 based on a determination that the sound signal is to be played; the method proceeds to operation at block 706 based on a determination that the sound signal is not to be played.

At block 704, the sound signal is played.

As an implementation, the operation at block 704 can be conducted as follows.

At block 7041, geographic location information of the sound signal is acquired via the headphone.

When the headphone is in a playing state, current geographic location information of the terminal device in communication with the headphone can be acquired. The current geographic location information of the terminal device can be taken as geographic location information of the headphone. The geographic location information of the headphone can be acquired by a built-in global positioning system (GPS) of the terminal device. Location information of the sound signal can be acquired by multiple microphones of the headphone. As an implementation, any one of the first speaker and the second speaker on the headphone can record the sound signal as a microphone. According to time delays of receiving the sound signal via the first microphone (or the second microphone), the first speaker, and the second speaker of the headphone, the location information of the sound signal relative to the headphone can be acquired.

Furthermore, according to the geographic location information of the headphone and the location information of the sound signal relative to the headphone, the geographic location information of the sound signal can be acquired.

At block 7042, a target audio file is generated according to the sound signal and the geographic location information of the sound signal, and the target audio file is played.

The acquired sound signal is bound to the geographical location information of the sound signal to generate the target audio file. Furthermore, the target audio file can also carry time information of collecting the sound signal, so that location information and the time information of the target audio file can be acquired in time, and the sound signal can be more richly displayed.

In response to a play instruction being received, play the target audio file, where the target audio file contains the geographic location information of collecting the sound signal and may further contain the time information of collecting the sound signal. When the user listens to the target audio file, he/she can be aware of where the sound signal comes from and can easily think back something. At the same time, when using the headphone, the user can know external situation through the target audio file recorded and can know outside conversation without wearing the headphone repeatedly, thereby avoiding missing important information.

At block 706, a stored audio file corresponding to the sound signal is deleted.

When no play instruction is received, it indicates that the recorded sound signal is not critical and the user does not need to play the sound signal. The stored audio file corresponding to the sound signal is deleted to save a storage space.

It should be understood that although the various steps in the flow charts of FIGS. 3-7 are sequentially displayed as indicated by the arrows, these steps are not necessarily performed in the order indicated by the arrows. Except as explicitly stated herein, the execution of these steps is not strictly limited, and the steps may be performed in other orders. Moreover, at least some of the steps in FIGS. 3-7 may include multiple sub-steps or multiple stages, which are not necessarily performed at the same time, and can be performed at different times, the order of execution of these sub-steps or stages is not necessarily performed sequentially, and can be performed in turn or alternately with at least a part of other steps or sub-steps or stages of other steps.

Figure 8:
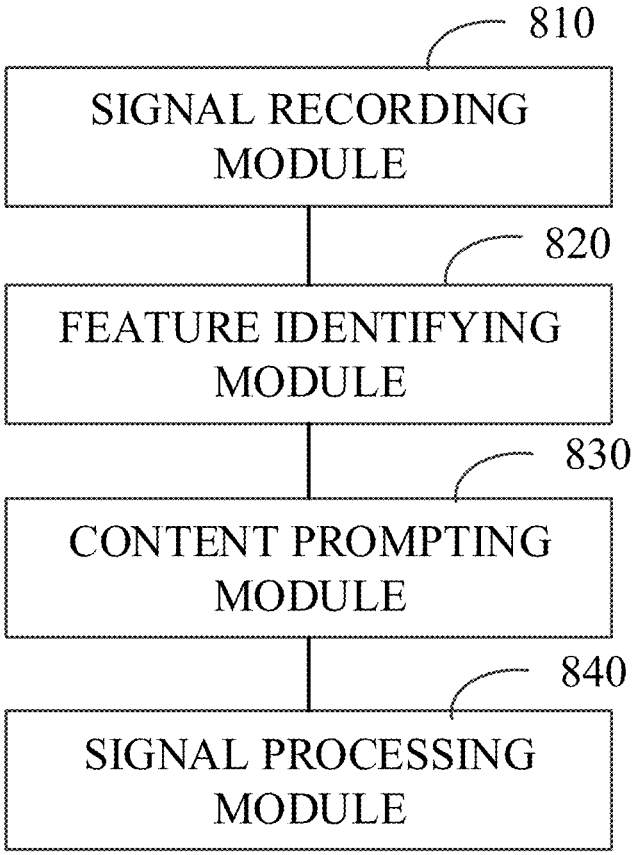
FIG. 8 is a schematic structural diagram illustrating an apparatus for processing signals according to an implementation of the present disclosure.

As illustrated in FIG. 8, an apparatus for processing signals is provided. The apparatus includes a signal recording module 810, a feature identifying module 820, a content prompting module 830, and a signal processing module 840.

The signal recording module 810 is configured to record a sound signal of external environment via a microphone of a headphone when the headphone is in a playing state.

The feature identifying module 820 is configured to identify feature audio in the sound signal and to acquire reminding information corresponding to the feature audio.

The content prompting module 830 is configured to inquire of a user whether recorded sound signal is critical according to the reminding information, in response to the headphone being paused.

The signal processing module 840 is configured to detect an input operation of the user and to process the sound signal according to the input operation of the user.

According to the apparatus for processing signals, the signal recording module 810 records the sound signal of the external environment via the microphone of the headphone when the headphone is in the playing state. The feature identifying module 820 identifies the feature audio in the sound signal and acquires the reminding information corresponding to the feature audio. The content prompting module 830 inquires of the user whether the recorded sound signal is critical according to the reminding information in response to the headphone being paused. The signal processing module 840 detects the input operation of the user and processes the sound signal according to the input operation of the user. With aid of technical solutions of the disclosure, headphone playing and external sound acquisition can be both implemented, and the user can be reminded according to the recorded content so that the user will not miss important information when he or she wears the headphone, thus improving convenience of using the headphone and enhancing use experience.

As an implementation, the signal recording module 810 is further configured to acquire the sound signal of the external environment recorded via the microphone of the headphone within a preset time period when music is played through the headphone, and to generate and store an audio file corresponding to the sound signal recorded.

As an implementation, the apparatus further includes a signal detecting module. The signal detecting module is configured to detect whether the sound signal contains a valid sound signal, and to conduct a smooth-filter process on the sound signal when the sound signal contains the valid sound signal.

As an implementation, the feature identifying module 820 is further configured to determine whether the sound signal contains the feature audio according to a preset sound model, and to determine the reminding information corresponding to the feature audio according to a correspondence between feature audio and reminding information, based on a determination that the sound signal contains the feature audio.

As an implementation, the content prompting module 830 is further configured to inquire of the user whether the recorded sound signal is critical according to the reminding information in response to music switching being detected, in the process of playing music through the headphone, or to inquire of the user whether the recorded sound signal is critical according to the reminding information in response to a music pause instruction being received, in the process of playing music through the headphone.

As an implementation, the signal processing module 840 is further configured to receive the input operation of the user on the headphone and to determine whether to play the sound signal according to the input operation, and to play the sound signal based on a determination that the sound signal is to be played or to delete a stored audio file corresponding to the sound signal based on a determination that the sound signal is not to be played.

As an implementation, the signal processing module 840 is further configured to acquire geographic location information of the sound signal via the headphone, to generate a target audio file according to the sound signal and the geographic location information of the sound signal, and to play the target audio file.

The division of each module in the above-mentioned apparatus for processing signals is for illustrative purposes only. In other implementations, the apparatus for processing signals may be divided into different modules as needed to complete all or part of the functions of the above-mentioned apparatus for processing signals.

For the specific definition of the apparatus for processing signals, reference may be made to the definition of the method for processing signals, and details are not described herein again. Each of the above-described apparatus for processing signals can be implemented in whole or in part by software, hardware, and combinations thereof. Each of the above modules may be embedded in or independent of a processor in a computer device, or may be stored in a memory in the computer device in a software form, so that the processor can invoke and implement the operations corresponding to the above modules.

The implementation of each module in the apparatus for processing signals provided in the implementations of the present disclosure may be in the form of a computer program. The computer program can run on a terminal device or server. The program modules of the computer program can be stored in the memory of the terminal device or server. When the computer program is executed by the processor, the operations of the method for processing signals described in the implementations of the present disclosure are implemented.

Implementations of the disclosure further provide a headphone. The headphone includes an electroacoustic transducer, a memory, and a processor. The processor is electrically coupled with the electroacoustic transducer and the memory, and the memory is configured to store the computer programs which, when executed by the processor, are configured to implement the method for processing signals provided in the above-mentioned implementations.

Implementations of the disclosure further provide a non-transitory computer-readable storage medium. The non-transitory computer-readable storage medium is configured to store a computer program which, when executed by a processor, causes the processor to carry out the method for processing signals provided in the above-mentioned implementations.

Implementations of the disclosure further provide a computer program product. The computer program product contains instructions which, when executed by the computer, are operable with the computer to implement the method for processing signals provided in the above-mentioned implementations.

Figure 9:
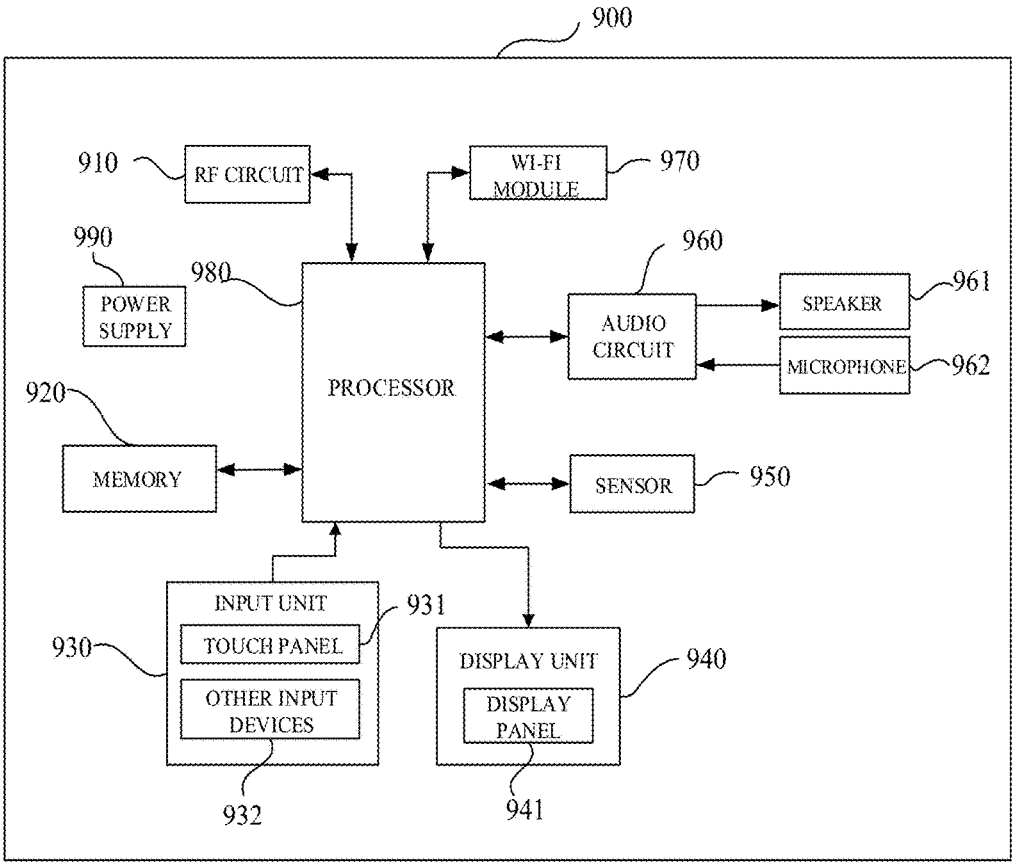
FIG. 9 is a block diagram illustrating a partial structure of a mobile phone related to a terminal device according to an implementation of the present disclosure.

Implementations of the disclosure further provide a terminal device. As illustrated in FIG. 9, only parts related to the implementations of the present disclosure are illustrated for ease of description. For technical details not described, reference may be made to the method implementations of the present disclosure. The terminal device may be any terminal device, such as a mobile phone, a tablet computer, a PDA, a point of sale terminal device (POS), an on-board computer, a wearable device, and the like. The following describes the mobile phone as an example of the terminal device.

FIG. 9 is a block diagram of a partial structure of a mobile phone related to a terminal device according to an implementation of the present disclosure. As illustrated in FIG. 9, the mobile phone includes a radio frequency (RF) circuit 910, a memory 920, an input unit 930, a display unit 940, a sensor 950, an audio circuit 960, a wireless fidelity (Wi-Fi) module 970, a processor 980, a power supply 990, and other components. Those skilled in the art can understand that the structure of the mobile phone illustrated in FIG. 9 does not constitute any limitation on the mobile phone. The mobile phone configured to implement technical solutions of the disclosure may include more or fewer components than illustrated, combine certain components, or have different component configuration.

The RF circuit 910 is configured to receive or transmit information, or receive or transmit signals during a call. As an implementation, the RF circuit 910 is configured to receive downlink information of a base station, which will be processed by the processor 980. In addition, the RF circuit 910 is configured to transmit uplink data to the base station. Generally, the RF circuit 910 includes, but is not limited to, an antenna, at least one amplifier, a transceiver, a coupler, a low noise amplifier (LNA), a duplexer, and the like. In addition, the RF circuit 910 may also communicate with the network and other devices via wireless communication. The above wireless communication may use any communication standard or protocol, which includes, but is not limited to, global system of mobile communication (GSM), general packet radio service (GPRS), code division multiple access (CDMA), wideband code division multiple access (WCDMA), long term evolution (LTE), E-mail, short messaging service (SMS), and so on.

The memory 920 is configured to store software programs and modules. The processor 980 is configured to execute various function applications and data processing of the mobile phone by running the software programs and the modules stored in the memory 920. The memory 920 may mainly include a program storage area and a data storage area. The program storage area may store an operating system, applications required for at least one function (such as sound playback function, image playback function, etc.). The data storage area may store data (such as audio data, a phone book, etc.) created according to use of the mobile phone, and so on. In addition, the memory 920 may include a high-speed RAM, and may further include a non-transitory memory such as at least one disk storage device, a flash device, or other non-transitory solid storage devices.

The input unit 930 may be configured to receive input digital or character information and to generate key signal input associated with user setting and function control of the mobile phone 900. As one implementation, the input unit 930 may include a touch panel 931 and other input devices 932. The touch panel 931, also known as a touch screen, is configured to collect touch operations generated by the user on or near the touch panel 931 (such as operations generated by the user using any suitable object or accessory such as a finger or a stylus to touch the touch panel 931 or areas near the touch panel 931), and to drive a corresponding connection device according to a preset program. As an implementation, the touch panel 931 may include two parts of a touch detection device and a touch controller. The touch detection device is configured to detect the user's touch orientation and a signal brought by the touch operation, and to transmit the signal to the touch controller. The touch controller is configured to receive the touch information from the touch detection device, to convert the touch information into contact coordinates, and to transmit the contact coordinates to the processor 980 again. The touch controller can also receive and execute commands from the processor 980. In addition, the touch panel 931 may be implemented in various types such as resistive, capacitive, infrared, surface acoustic waves, etc. In addition to the touch panel 931, the input unit 930 may further include other input devices 932. The input devices 932 include, but are not limited to, one or more of a physical keyboard, function keys (such as volume control buttons, switch buttons, etc.).

The display unit 940 is configured to display information input by the user, information provided for the user, or various menus of the mobile phone. The display unit 940 may include a display panel 941. As an implementation, the display panel 941 may be in the form of a liquid crystal display (LCD), an organic light-emitting diode (OLED), and so on. As an implementation, the touch panel 931 may cover the display panel 941. After the touch panel 931 detects a touch operation on or near the touch panel 931, the touch panel 931 transmits the touch operation to the processor 980 to determine a type of the touch event, and then the processor 980 provides a corresponding visual output on the display panel 941 according to the type of the touch event. Although in FIG. 9, the touch panel 931 and the display panel 941 function as two independent components to implement input and output functions of the mobile phone, in some implementations, the touch panel 931 and the display panel 941 may be integrated to achieve the input and output functions of the mobile phone.

The mobile phone 900 may further include at least one type of sensor 950, such as a light sensor, a motion sensor, and other sensors. As one implementation, the light sensor may include an ambient light sensor and a proximity sensor, among which the ambient light sensor may adjust the brightness of the display panel 941 according to ambient lights, and the proximity sensor may turn off the display panel 941 and/or backlight when the mobile phone reaches nearby the ear. As a kind of motion sensor, an accelerometer sensor can detect magnitude of acceleration in all directions, and when the mobile phone is stationary, the accelerometer sensor can detect the magnitude and direction of gravity; the accelerometer sensor can also be configured for applications related to identification of mobile-phone gestures (such as vertical and horizontal screen switch), or can be used for vibration-recognition related functions (such as a pedometer, percussion), and so on. In addition, the mobile phone can also be equipped with a gyroscope, a barometer, a hygrometer, a thermometer, an infrared sensor, and other sensors.

The audio circuit 960, a speaker 961, and a microphone 962 may provide an audio interface between the user and the mobile phone. The audio circuit 960 may convert the received audio data to electrical signals and transmit the electrical signals to the speaker 961; thereafter the speaker 961 may convert the electrical signals to sound signals to output. On the other hand, the microphone 962 may convert the received sound signals to electrical signals, which will be received and converted to audio data by the audio circuit 960 to output to the processor 980. The audio data is then processed by the processor 980 and transmitted via the RF circuit 910 to another mobile phone. Alternatively, the audio data may be output to the memory 920 for further processing.

Wi-Fi belongs to a short-range wireless transmission technology. With aid of the Wi-Fi module 970, the mobile phone may assist the user in E-mail receiving and sending an E-mail, browsing through webpage, accessing to streaming media, and the like. Wi-Fi provides users with wireless broadband Internet access. Although the Wi-Fi module 970 is illustrated in FIG. 9, it should be understood that the Wi-Fi module 970 is not necessary to the mobile phone 900 and can be omitted according to actual needs.

The processor 980 is a control center of the mobile phone. The processor 980 connects various parts of the entire mobile phone through various interfaces and lines. By running or executing software programs and/or modules stored in the memory 920 and calling data stored in the memory 920, the processor 980 can execute various functions of the mobile phone and conduct data processing, so as to monitor the mobile phone as a whole. As an implementation, the processor 980 can include at least one processing unit. As an implementation, the processor 980 can be integrated with an application processor and a modem processor, where the application processor is mainly configured to handle an operating system, a user interface, applications, and so on and the modem processor is mainly configured to deal with wireless communication. It will be appreciated that the modem processor mentioned above may not be integrated into the processor 980. For example, the processor 980 can integrate an application processor and a baseband processor, and the baseband processor and other peripheral chips can form a modem processor. The mobile phone 900 further includes a power supply 990 (such as a battery) that supplies power to various components. For instance, the power supply 990 may be logically coupled to the processor 980 via a power management system to enable management of charging, discharging, and power consumption through the power management system.

As an implementation, the mobile phone 900 may include a camera, a Bluetooth module, and so on.

In the implementation of the present disclosure, the processor 980 included in the mobile phone implements the method for processing signals described above when executing computer programs stored in the memory.

When the computer programs running on the processor are executed, headphone playing and external sound acquisition can be both considered, the user can be reminded according to the recorded content so that the user will not miss important information when he or she wears the headphone, thus improving convenience of using the headphone and enhancing use experience.

Any reference to a memory, storage, database, or other medium used herein may include non-transitory and/or transitory memories. Suitable non-transitory memories can include ROM, programmable ROM (PROM), electrically programmable ROM (EPROM), electrically erasable programmable ROM (EEPROM), or flash memory. Transitory memory can include RAM, which acts as an external cache. By way of illustration and not limitation, RAM is available in a variety of formats, such as static RAM (SRAM), dynamic RAM (DRAM), synchronous DRAM (SDRAM), double data rate SDRAM (DDR SDRAM), enhanced SDRAM (ESDRAM), synchronization link DRAM (SLDRAM), Rambus direct RAM (RDRAM), direct Rambus dynamic RAM (DRDRAM), and Rambus dynamic RAM (RDRAM).

While the disclosure has been described in connection with certain implementations, it is to be understood that the disclosure is not to be limited to the disclosed implementations but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A method for processing signals, comprising:

recording, via a microphone of a headphone, a sound signal of external environment when the headphone is in a playing state;

identifying feature audio in the sound signal and acquiring reminding information corresponding to the feature audio;

inquiring of a user whether recorded sound signal is critical according to the reminding information, in response to the headphone being paused; and detecting an input operation of the user and processing the sound signal according to the input operation of the user.

2. The method of claim 1, wherein the microphone comprises a first microphone and a second microphone, and the recording, via a microphone of a headphone, a sound signal of external environment when the headphone is in a playing state comprises one of the following:

recording, via the first microphone of the headphone, the sound signal of external environment when playing music through the headphone; and recording, via the second microphone of the headphone, the sound signal of external environment when the user talking through the headphone.

3. The method of claim 2, wherein the recording, via a microphone of a headphone, a sound signal of external environment when the headphone is in a playing state comprises:

acquiring the sound signal of the external environment recorded via the first microphone of the headphone within a preset time period when playing music through the headphone, the preset time period being determined according to a time period in which the music is played; and generating and storing an audio file corresponding to the sound signal recorded.

4. The method of claim 1, further comprising the following prior to the identifying feature audio in the sound signal:

detecting whether the sound signal contains a valid sound signal; and conducting a smooth-filter process on the sound signal when the sound signal contains the valid sound signal.

5. The method of claim 1, wherein the identifying feature audio in the sound signal and acquiring reminding information corresponding to the feature audio comprises:

determining whether the sound signal contains the feature audio according to a preset sound model; and determining the reminding information corresponding to the feature audio according to a correspondence between feature audio and reminding information, based on a determination that the sound signal contains the feature audio.

6. The method of claim 5, wherein the determining whether the sound signal contains the feature audio according to a preset sound model comprises at least one of:

extracting noise information in the sound signal and determining whether the noise information matches a preset noise model;

extracting voiceprint information in the sound signal and determining whether the voiceprint information matches a sample voiceprint information; and extracting sensitive information in the sound signal and determining whether the sensitive information matches a preset keyword.

7. The method of claim 1, wherein the inquiring of a user whether recorded sound signal is critical according to the reminding information, in response to the headphone being paused comprises one of:

inquiring of the user whether the recorded sound signal is critical according to the reminding information in response to music switching being detected, in a process of playing music through the headphone; or inquiring of the user whether the recorded sound signal is critical according to the reminding information in response to a music pause instruction being received, in the process of playing music through the headphone.

8. The method of claim 1, wherein the detecting an input operation of the user and processing the sound signal according to the input operation comprises:

receiving the input operation of the user on the headphone and determining whether to play the sound signal according to the input operation; and playing the sound signal based on a determination that the sound signal is to be played; or deleting a stored audio file corresponding to the sound signal based on a determination that the sound signal is not to be played.

9. The method of claim 8, wherein the playing the sound signal comprises:

acquiring, via the headphone, at least one of geographic location information and time information of the sound signal; and generating a target audio file according to the sound signal and the at least one of geographic location information and time information of the sound signal, and playing the target audio file.

10. A terminal device, comprising:

at least one processor; and a computer readable storage, coupled to the at least one processor and storing at least one computer executable instruction thereon which, when executed by the at least one processor, cause the at least one processor to carry out actions, comprising;

recording a sound signal of external environment when a headphone is in a playing state;

identifying feature audio in the sound signal and acquiring reminding information corresponding to the feature audio;

inquiring of a user whether recorded sound signal is critical according to the reminding information, in response to the headphone being paused; and detecting an input operation of the user and processing the sound signal according to the input operation of the user.

11. The terminal device of claim 10, wherein the at least one processor carrying out the action of recording the sound signal of external environment when the headphone is in the playing state is caused to carry out actions, comprising:

acquiring the sound signal of the external environment within a preset time period when playing music through the headphone, the preset time period being determined according to a time period in which the music is played; and generating and storing an audio file corresponding to the sound signal recorded.

12. The terminal device of claim 10, wherein the at least one processor is further caused to carry out actions, comprising:

detecting whether the sound signal contains a valid sound signal; and conducting a smooth-filter process on the sound signal when the sound signal contains the valid sound signal.

13. The terminal device of claim 10, wherein the at least one processor carrying out the action of identifying the feature audio in the sound signal and acquiring the reminding information corresponding to the feature audio is caused to carry out actions, comprising:

determining whether the sound signal contains the feature audio according to a preset sound model; and determining the reminding information corresponding to the feature audio according to a correspondence between feature audio and reminding information, based on a determination that the sound signal contains the feature audio.

14. The terminal device of claim 13, wherein the at least one processor carrying out the action of determining whether the sound signal contains the feature audio according to the preset sound model is caused to carry out actions, comprising at least one of:

extracting noise information in the sound signal and determining whether the noise information matches a preset noise model;

extracting voiceprint information in the sound signal and determining whether the voiceprint information matches a sample voiceprint information; and extracting sensitive information in the sound signal, determining whether the sensitive information matches a preset keyword.

15. The terminal device of claim 10, wherein the at least one processor carrying out the action of inquiring of the user whether recorded sound signal is critical according to the reminding information, in response to the headphone being paused is caused to carry out actions, comprising one of:

inquiring of the user whether the recorded sound signal is critical according to the reminding information in response to music switching being detected, in a process of playing music through the headphone; or inquiring of the user whether the recorded sound signal is critical according to the reminding information in response to a music pause instruction being received, in the process of playing music through the headphone.

16. The terminal device of claim 10, wherein the at least one processor carrying out the action of detecting the input operation of the user and processing the sound signal according to the input operation is caused to carry out actions, comprising:

receiving the input operation of the user on the headphone and determining whether to play the sound signal according to the input operation; and playing the sound signal based on a determination that the sound signal is to be played; or deleting a stored audio file corresponding to the sound signal based on a determination that the sound signal is not to be played.

17. The terminal device of claim 16, wherein the at least one processor carrying out the action of playing the sound signal is caused to carry out actions, comprising:

acquiring, via the headphone, at least one of geographic location information and time information of the sound signal; and generating a target audio file according to the sound signal and the at least one of geographic location information and time information of the sound signal, and playing the target audio file.

18. A non-transitory computer-readable storage medium storing a computer program which, when executed by a processor, causes the processor to carry out actions, comprising:

recording a sound signal of external environment when a headphone is in a playing state;

identifying feature audio in the sound signal and acquiring reminding information corresponding to the feature audio;

inquiring of a user whether recorded sound signal is critical according to the reminding information, in response to the headphone being paused; and detecting an input operation of the user and processing the sound signal according to the input operation of the user.

19. The non-transitory computer-readable storage medium of claim 18, wherein the computer program which, when executed by a processor, further causes the processor to carry out actions, comprising:

detecting whether the sound signal contains a valid sound signal; and conducting a smooth-filter process on the sound signal when the sound signal contains the valid sound signal.

20. The non-transitory computer-readable storage medium of claim 18, wherein the computer program which, when executed by a processor, causing the processor to carry out actions of identifying the feature audio in the sound signal and acquiring the reminding information corresponding to the feature audio comprising further causes the processor to carry out actions, comprising:

determining whether the sound signal contains the feature audio according to a preset sound model; and determining the reminding information corresponding to the feature audio according to a correspondence between feature audio and reminding information, based on a determination that the sound signal contains the feature audio.

* * * * *